US010519847B2

(12) United States Patent
Elia et al.

(10) Patent No.: US 10,519,847 B2
(45) Date of Patent: Dec. 31, 2019

(54) SYSTEM AND METHOD FOR MANAGING TEMPERATURE IN AIR-COOLED ENGINES

(71) Applicant: NOVATIO Engineering, Inc., Waltham, MA (US)

(72) Inventors: Mimmo Elia, Belmont, MA (US); Jason Targoff, Cambridge, MA (US); John Waldron, Boston, MA (US); Michael Peterson, Boston, MA (US)

(73) Assignee: NOVATIO ENGINEERING, INC., Waltham, MA (US)

( * ) Notice: Subject to any disclaimer, the term of this patent is extended or adjusted under 35 U.S.C. 154(b) by 0 days.

(21) Appl. No.: 15/431,580

(22) Filed: Feb. 13, 2017

(65) Prior Publication Data

US 2017/0234206 A1 Aug. 17, 2017

Related U.S. Application Data

(60) Provisional application No. 62/294,630, filed on Feb. 12, 2016.

(51) Int. Cl.
*F01P 7/12* (2006.01)
*F02B 63/04* (2006.01)

(52) U.S. Cl.
CPC ..... *F01P 7/12* (2013.01); *F02B 63/048* (2013.01); *F01P 2037/02* (2013.01)

(58) Field of Classification Search
CPC .. F01P 7/12; F01P 1/06; F01P 2050/00; F01P 2037/02; F02B 63/048
See application file for complete search history.

(56) References Cited

U.S. PATENT DOCUMENTS

| | | | | |
|---|---|---|---|---|
| 2,354,364 | A | 7/1944 | Chapman | |
| 2,482,461 | A | 9/1949 | Browne et al. | |
| 2,499,144 | A | 2/1950 | Jarvis | |
| 2,645,212 | A | 7/1953 | Bogaards | |
| 4,942,348 | A | 7/1990 | Nilssen | |
| 6,142,108 | A | 11/2000 | Blichmann | |
| 7,766,111 | B2 * | 8/2010 | Guilfoyle | B60K 11/04 180/68.1 |

(Continued)

*Primary Examiner* — Joseph J Dallo
(74) *Attorney, Agent, or Firm* — Roberts Mlotkowski Safran Cole & Calderon, P.C.

(57) ABSTRACT

An automated system for managing temperature and reducing crankcase oil dilution in an internal combustion engine. The system includes a rotatable shutter plate having an open portion, a closed portion and a peripheral rim, the peripheral rim having a frictional surface thereon; a motor having a rotatable shaft having a pinion affixed at one end thereof for engagement with the frictional surface of the peripheral rim of the rotatable shutter plate; and a temperature sensor for monitoring a temperature indicative of engine warm-up and sending a signal to a controller; wherein the rotatable shutter plate is structured and arranged to at least partially occlude an air inlet to or outlet from the internal combustion engine when rotated in response to a signal received from the controller. A method of reducing crankcase oil dilution and managing temperature in a spark-ignited engine operating on middle-distillate fuel and a portable engine or engine-generator combination having multi-fuel capability are also provided.

37 Claims, 3 Drawing Sheets

(56) References Cited

U.S. PATENT DOCUMENTS

| | | | | |
|---|---|---|---|---|
| 8,091,668 | B2 * | 1/2012 | Amano | B60K 6/445 123/41.05 |
| 8,517,130 | B2 * | 8/2013 | Sakai | B60K 11/085 180/68.1 |
| 8,561,738 | B2 * | 10/2013 | Charnesky | B60K 11/085 180/68.1 |
| 8,646,552 | B2 * | 2/2014 | Evans | B60K 11/085 180/68.1 |
| 8,689,917 | B2 * | 4/2014 | Miesterfeld | F01P 7/10 180/68.1 |
| 8,708,075 | B2 * | 4/2014 | Maurer | B60R 19/52 180/68.1 |
| 8,794,360 | B2 * | 8/2014 | Nemoto | B60K 11/085 180/68.1 |
| 8,794,363 | B2 * | 8/2014 | Wolf | B60K 11/085 180/68.1 |
| 8,915,320 | B2 * | 12/2014 | Chinta | B60K 11/085 180/68.1 |
| 8,919,470 | B2 * | 12/2014 | Hori | B60K 11/085 180/68.1 |
| 8,922,033 | B2 | 12/2014 | Vallinayagam et al. | |
| 9,694,858 | B2 * | 7/2017 | Wolf | B62D 37/02 |
| 9,701,191 | B2 * | 7/2017 | Yoshioka | B60K 11/085 |
| 9,809,108 | B2 * | 11/2017 | Ribaldone | B60K 11/085 |
| 2010/0011893 | A1 * | 1/2010 | Kawamoto | F16H 55/18 74/411 |
| 2010/0147611 | A1 * | 6/2010 | Amano | B60K 6/365 180/68.1 |

* cited by examiner

SYSTEM AND METHOD FOR MANAGING TEMPERATURE IN AIR-COOLED ENGINES

FIELD

The present disclosure relates to temperature management for air-cooled engines, in particular, air-cooled spark-ignited engines that operate on gasoline, mid-distillate fuels, oxygenates, blends of oxygenates and gasoline or mid-distillate fuels, or any of these.

BACKGROUND

The need to power portable electronics equipment, communications gear, medical devices and other equipment in remote field service has been on the rise in recent years, increasing the demand for efficient, mobile power systems. These applications require power sources that provide both high power and energy density, while also requiring minimal size and weight, and cost.

To date, batteries have been the principle means for supplying portable sources of power. However, due to the time required for recharging, batteries have proven inconvenient for continuous use applications. Moreover, portable batteries are generally limited to power production in the range of several milliwatts to a few watts and thus cannot address the need for significant levels of mobile, lightweight power production.

Small generators powered by internal combustion engines, whether gasoline- or diesel-fueled have also been used. However, field situations, particularly in military applications, can demand multi-fuel capabilities. Gas turbine powered generators possess multi-fuel capability and can produce power at high efficiencies. While relatively low-efficiency micro-turbines exist, the majority of gas turbine engines are large and not well suited to field applications requiring high mobility. While conventional heat engines powered by high energy density liquid fuels offer advantages with respect to size, thermodynamic scaling and cost considerations have tended to favor larger power plants.

In view of these factors, a void exists with regard to power systems in the size range of 500 to 5000 watts. Moreover, in order to take advantage of mid-distillate high energy density liquid fuels, improved systems for managing temperature and reducing crankcase oil dilution in a spark-ignited internal combustion engine are needed.

Therefore, what is needed is a portable power system having multi-fuel capabilities that takes advantage of high energy density liquid fuels, including mid-distillates, while minimizing crankcase oil dilution.

SUMMARY

In one aspect, provided is an automated system for managing temperature and reducing fuel dilution in an internal combustion engine. The system includes a rotatable shutter plate having an open portion, a closed portion and a peripheral rim; a motor having a rotatable shaft for rotating the rotatable shutter plate; and a temperature sensor for monitoring engine temperature and sending a signal to a controller, wherein the rotatable shutter plate is structured and arranged to at least partially restrict air flow to the internal combustion engine when rotated in response to a signal received from the controller.

In some embodiments, the peripheral rim comprises a frictional surface. In some embodiments, the frictional surface of the peripheral rim comprises a series of gear teeth.

In some embodiments, the rotatable shaft of the motor comprises a pinion affixed at one end thereof for engagement with the frictional surface of the peripheral rim.

In some embodiments, the pinion affixed to the rotatable shaft comprises a series of gear teeth for meshing with the series of gear teeth of the frictional surface of the peripheral rim.

In some embodiments, the rotatable shutter plate at least substantially occludes the air inlet or outlet when rotated to a first position and minimally occludes the air inlet or outlet when rotated to a second position.

In some embodiments, the system further comprises a base plate for mounting the rotatable shutter plate thereto, the base plate having an open section and a closed section.

In some embodiments, the base plate is positioned over the air inlet to or outlet from the internal combustion engine.

In some embodiments, the base plate is formed from a thermoplastic material.

In some embodiments, the rotatable shutter plate is formed from a metallic material.

In some embodiments, the metallic material comprises aluminum.

In another aspect, provided is a method of reducing fuel dilution and managing temperature in a spark-ignited engine operating in very cold temperatures or on middle-distillate fuel. The method includes starting the spark-ignited engine; monitoring engine temperature and sending a signal to a controller; and at least partially restricting air flow to the spark-ignited engine in response to a signal received from the controller.

In some embodiments, the step of at least partially occluding an air inlet to or outlet from the spark-ignited engine in response to a signal received from the controller employs a system comprising (i) a rotatable shutter plate having an open portion, a closed portion and a peripheral rim; and (ii) a motor having a rotatable shaft for rotating the rotatable shutter plate.

In some embodiments, the peripheral rim comprises a frictional surface.

In some embodiments, the frictional surface of the peripheral rim comprises a series of gear teeth.

In some embodiments, the rotatable shaft of the motor comprises a pinion affixed at one end thereof for engagement with the frictional surface of the peripheral rim.

In some embodiments, the pinion affixed to the rotatable shaft comprises a series of gear teeth for meshing with the series of gear teeth of the frictional surface of the peripheral rim.

In some embodiments, the rotatable shutter plate at least substantially occludes the air inlet or outlet when rotated to a first position and minimally occludes the air inlet or outlet when rotated to a second position.

In some embodiments, the step of at least partially occluding an air inlet to or outlet from the spark-ignited engine in response to a signal received from the controller further employs a base plate for mounting the rotatable shutter plate thereto, the base plate having an open section and a closed section.

In some embodiments, the base plate is positioned over the air inlet to or outlet from the internal combustion engine.

In some embodiments, the base plate is formed from a thermoplastic material.

In some embodiments, the rotatable shutter plate is formed from a metallic material.

In some embodiments, the metallic material comprises aluminum.

In yet another aspect, provided is a portable engine or engine-generator combination having multi-fuel capability. The portable engine or engine-generator combination includes an internal combustion engine for powering an electrical generator, the internal combustion engine having an air inlet and an exhaust; and an automated system for managing temperature and reducing fuel dilution in the internal combustion engine, the system including a rotatable shutter plate having an open portion, a closed portion and a peripheral rim; a motor having a rotatable for rotating the rotatable shutter plate; and a temperature sensor for monitoring a temperature indicative of engine warm-up and sending a signal to a controller, wherein the rotatable shutter plate is structured and arranged to at least partially restrict air flow to the internal combustion engine when rotated in response to a signal received from the controller.

In some embodiments, the peripheral rim comprises a frictional surface.

In some embodiments, the frictional surface of the peripheral rim comprises a series of gear teeth.

In some embodiments, the rotatable shaft of the motor comprises a pinion affixed at one end thereof for engagement with the frictional surface of the peripheral rim.

In some embodiments, the pinion affixed to the rotatable shaft comprises a series of gear teeth for meshing with the series of gear teeth of the frictional surface of the peripheral rim.

In some embodiments, the rotatable shutter plate at least substantially occludes an air inlet or an air outlet when rotated to a first position and minimally occludes the air inlet or the air outlet when rotated to a second position.

In some embodiments, the portable engine or engine-generator combination further includes a base plate for mounting the rotatable shutter plate thereto, the base plate having an open section and a closed section.

In some embodiments, the base plate is positioned over the air inlet to or outlet from the internal combustion engine.

In some embodiments, the base plate is formed from a thermoplastic material.

In some embodiments, the rotatable shutter plate is formed from a metallic material.

In some embodiments, the metallic material comprises aluminum.

In some embodiments, the internal combustion engine is an air-cooled internal combustion engine.

In another aspect, provided is a method to sense when the shutter plate reaches its full extent of travel so as to avoid driving the shutter plate against its structural or physical limits. In some embodiments, a sensor indicates to the control system when the shutter has reached its full extent of travel through the use of one or more switches or other sensing components, to prevent the motor from driving the shutter plate against a hard stop. A method to sense that the plate has reached its full extent of travel is provided that holds the shutter plate metal at an elevated potential (e.g. 5V) until it makes contact with a grounding surface (i.e., engine components, such as a muffler) at its extreme positions. The voltage of the metallic plate can be sensed to indicate that the shutter is in contact with another component and limit the driving of the motor when the shutter is fully open or closed.

DETAILED DESCRIPTION

Figure 1:
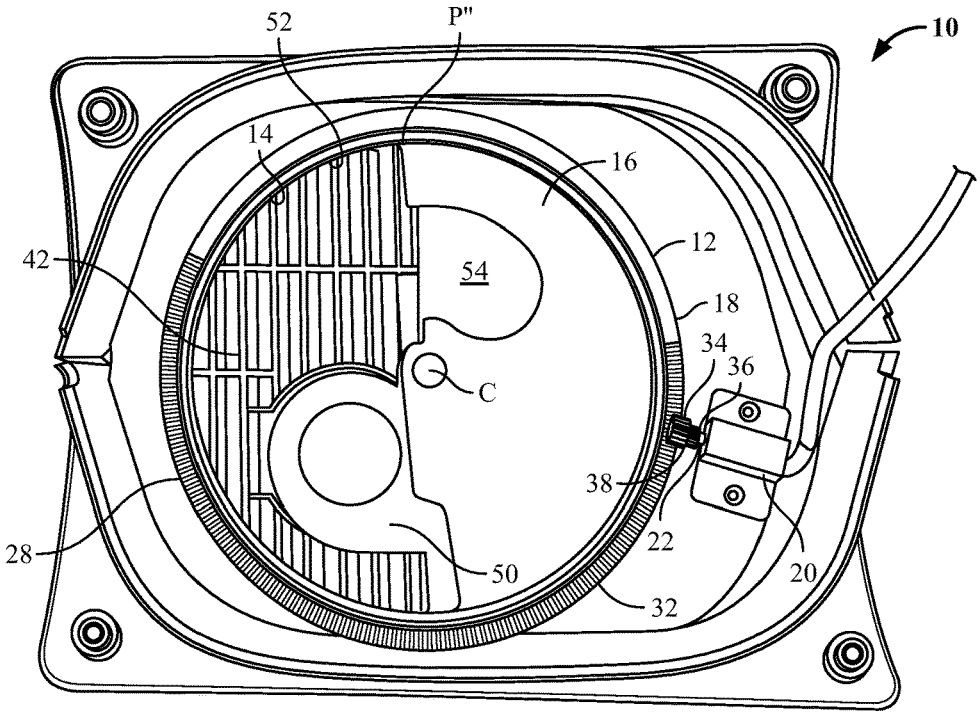
FIG. 1 presents a plan view of an illustrative, non-exclusive example of an automated system for managing temperature and reducing fuel dilution in an internal combustion engine, according to the present disclosure.

FIGS. 1-4 provide illustrative, non-exclusive examples of automated systems for managing temperature and reducing fuel dilution having utility in connection with spark ignited engines and engine-generator combinations having multi-fuel capabilities, and/or of systems, apparatus, and/or assemblies that may include, be associated with, be operatively attached to, and/or utilize the systems and methods disclosed herein.

In general, structures and/or features that are, or are likely to be, included in a given embodiment are indicated in solid lines in FIGS. 1-4, while optional structures and/or features are indicated in broken lines. However, a given embodiment is not required to include all structures and/or features that are illustrated in solid lines therein, and any suitable number of such structures and/or features may be omitted from a given embodiment without departing from the scope of the present disclosure.

Disclosed herein are temperature management systems and methods having utility with a wide variety of engines. In some embodiments, the systems and methods disclosed herein may be adopted to air-cooled spark-ignited engines. In some embodiments, the air-cooled spark-ignited engines may be operated on middle distillate fuels.

When operating an air-cooled spark-ignited engine on middle distillate fuels, of particular concern, is how to avoid the build-up of fuel in the crank case when operating spark-ignited engines with fuels less volatile than gasoline. This condition is known to those skilled in the art as fuel dilution, crankcase dilution or oil dilution. In some embodiments, middle distillate fuels, such as diesel fuel, jet fuel, oxygenated blends of middle distillate fuels, biofuels and biofuel blends and mixtures thereof may be employed.

The present disclosure provides systems and methods to manage the temperature of engine oil such that if a spark-ignition engine is operated with less volatile fuels, such as diesel, kerosene, or jet fuels, the oil temperature is maintained to enable fuels to volatilize off the oil in the same manner gasoline does at lower temperatures, and therefore fuel dilution of crankcase oil is prevented or reduced to an acceptable level.

The methods and systems disclosed herein manage temperature through an automated "shutter" system that opens or closes to control a quantity of cooling air that flows past the engine. The shutter system is driven by a small motor that is controlled by a motor controller based on the readings of a temperature sensor.

Referring now to FIGS. 1-4, an automated system 10 for managing temperature and reducing fuel dilution in an internal combustion engine 30 is presented. In some embodiments, the internal combustion engine is an air-cooled internal combustion engine 30. The system 10 disclosed herein includes a rotatable shutter plate 12 having an open portion 14, a closed portion 16 and a peripheral rim 18.

Referring again to FIGS. 1 and 2, the peripheral rim 18 of the rotatable shutter plate 12 includes a frictional surface 28. As shown in FIG. 1, in some embodiments, the frictional surface 28 of the peripheral rim 18 of the rotatable shutter plate 12 includes a series of gear teeth 32.

The system 10 also includes a motor 20 having a rotatable shaft 22 for rotating the rotatable shutter plate 12. In some embodiments, the rotatable shaft 22 of the motor 20 includes a pinion 34 affixed at one end 36 thereof for engagement with the frictional surface 28 of the peripheral rim 18. In some embodiments, the pinion 34 affixed to the rotatable shaft 22 includes a series of gear teeth 38 for meshing with the series of gear teeth 32 of the frictional surface 28 of the peripheral rim 18.

Figure 3:
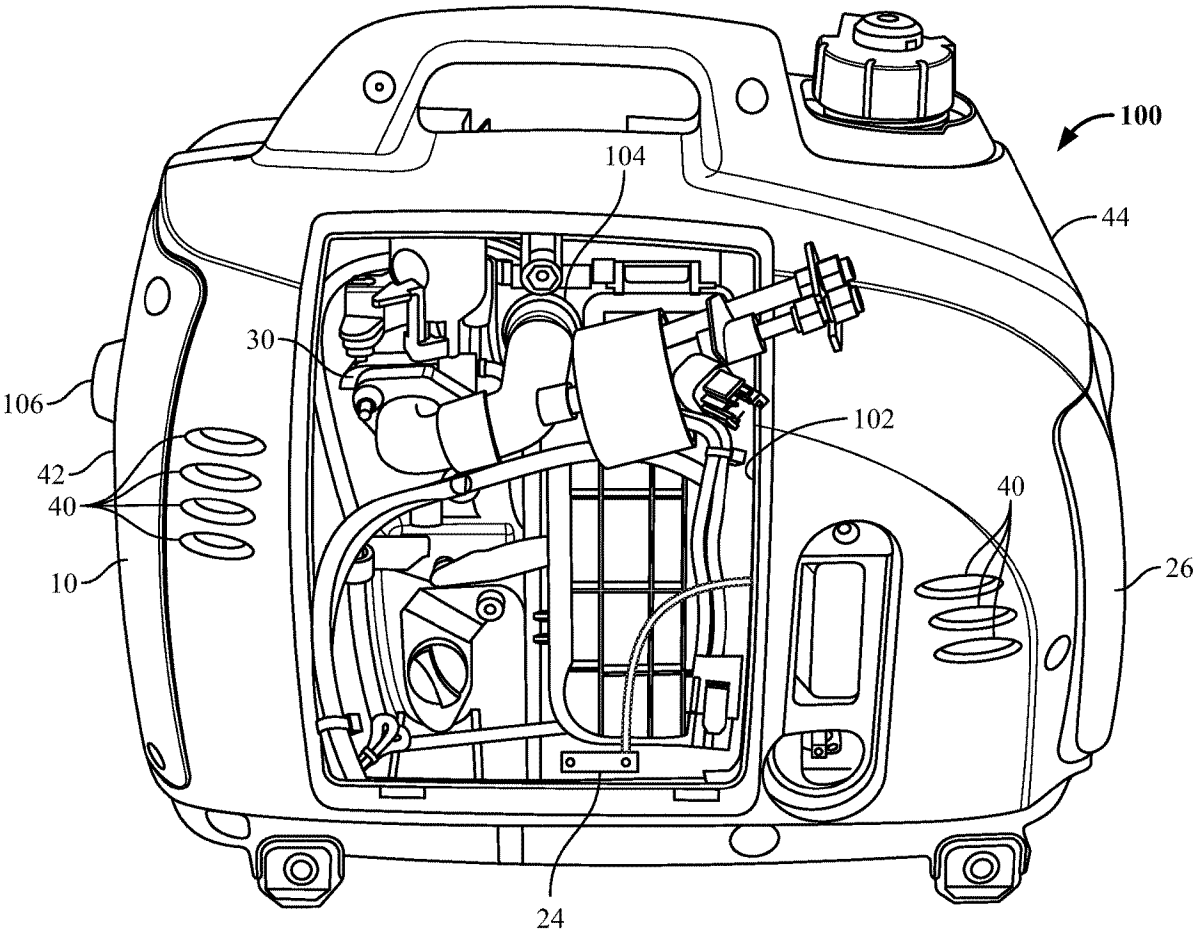
FIG. 3 presents a perspective view of an illustrative, non-exclusive example of a portable engine-generator combination having multi-fuel capability, according to the present disclosure.

Referring now to FIG. 3, a temperature sensor 24 for monitoring a temperature indicative of engine warm-up and sending a signal to a controller 26. Advantageously, the rotatable shutter plate 12 is structured and arranged to at least partially restrict air flow inlet to the internal combustion engine 30 when rotated in response to a signal received from the controller 26.

In operation, when fuel dilution can be problematic, the rotatable shutter plate 12 may be rotated to a first position P', so as to at least substantially occlude the air inlet(s) 40 or the air outlet 42 (see FIG. 4) of engine housing 44. When the engine 30 is at, or has approached, operating temperature, the rotatable shutter plate 12 may be rotated to a second position P" (see FIG. 1), so as to minimally occlude the air inlet 40 or the air outlet 42.

Figure 2:
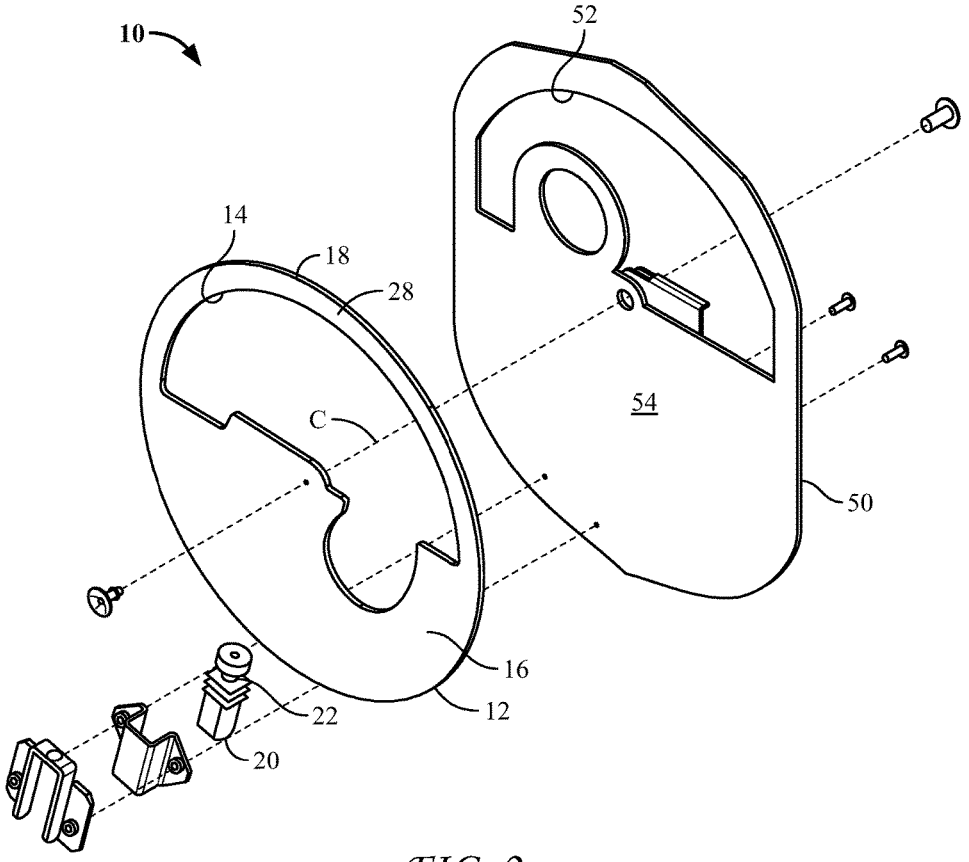
FIG. 2 presents an exploded view of a portion of an automated system for managing temperature and reducing fuel dilution in an internal combustion engine, according to the present disclosure.

Referring to FIGS. 1 and 2, system 10 may further include a base plate 50 for mounting the rotatable shutter plate 12 thereto. As shown, the base plate 50 is provided with an open section 52 and a closed section 54, for aligning with the rotatable shutter plate 12. The base plate 50 may be positioned over the air inlet(s) 40 or the air outlet 42 (as shown in FIG. 1), to the internal combustion engine 30. In some embodiments, the base plate 50 may be formed from a thermoplastic material.

In some embodiments, the rotatable shutter plate 12 may be formed from a metallic material. In some embodiments, the metallic material comprises aluminum. As indicated, the rotatable shutter plate 12 may be provided with an open portion 14 cut into it to enable operation with cooling channels open or closed, depending on the position of the rotatable shutter plate 12. The rotatable shutter plate 12 can be driven with any kind of friction coupling between the motor 20 and the rotatable shutter plate 12, including by a gear mechanism, as described above. The system 10 may be provided with a friction/drum mechanism (not shown) or with the gear mechanism shown in FIG. 1, which includes gear-teeth formed into the aluminum the rotatable shutter plate 12 to mesh with the motor-driven pinion gear 34.

The motor 20 may be controlled to move the disc in either direction to open, if the engine 30 is warmer than a set point, or close, if the engine 30 is cooler than the set point. The rotatable shutter plate 12 rotates around a center axis C and is provided with roughly a 50% opening to provide full closure of air pathways when rotated to the closed position P' and full opening when rotated to the open position P" (See FIG. 1).

The aluminum disc that forms the rotatable shutter plate 12 must have adequate flexibility to make a good seal with bearing surfaces, while also providing ability to conform to the shape of the existing components of the engine exhaust assembly to allow rotation driven by a small motor.

The gearing of the aluminum disc can be achieved with a small tool. Forming teeth in the aluminum disc of the rotatable shutter plate 12 can provide a low cost method to make the drive-train of the rotatable shutter plate 12, as well as providing a means to maintain the flexibility that is required.

As described hereinabove, the automation of the rotatable shutter plate 12 provides for temperature control. It has been observed that a small change in shutter opening can make a substantive difference in engine temperature and, as such, it is therefore not practical to monitor temperatures and control a manual shutter position with fine control.

In some embodiments, a sensor is provided to indicate to the controller when the shutter plate reaches its full extent of travel in order to avoid driving the shutter plate against its structural or physical limit. A sensor indicates to the control system when the shutter has reached its full extent of travel by use of one or more switches or other sensing components, to prevent the motor from driving the shutter plate against a hard stop. A method to sense that the plate has reached its full extent of travel includes holding the shutter plate's metallic structure at an elevated potential (e.g. 5V) until it makes contact with a grounding surface (i.e., an engine component, such as a muffler) at its extreme positions. The voltage of the metallic plate can be sensed to indicate that the shutter is in contact with another component and limit the driving of the motor when the shutter is fully open or closed.

The motor and driving voltage are set such that when the rotatable shutter plate 12 is at its extreme opened P" or closed positions P', and the control system 26 makes an attempt to further close or open the shutter, the motor 20 stalls to prevent any damage to the sheet metal components.

Figure 4:
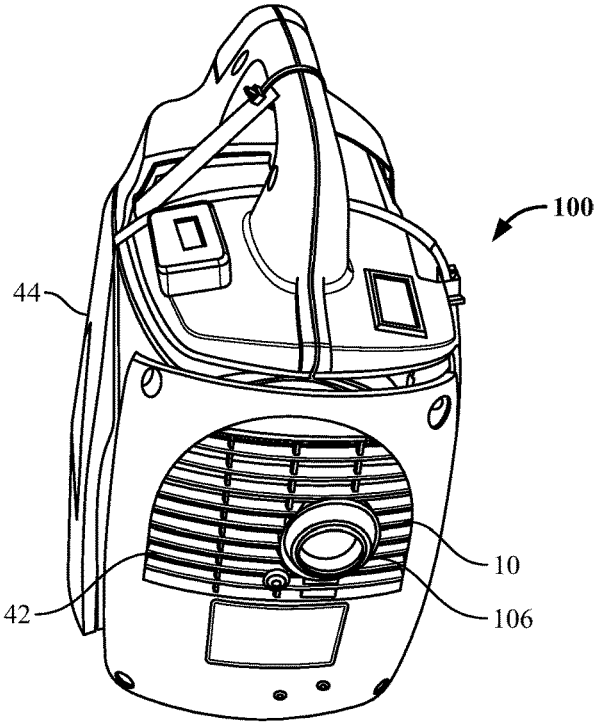
FIG. 4 presents a rear plan view of an illustrative, non-exclusive example of a portable engine-generator combination having multi-fuel capability, according to the present disclosure.

Referring now to FIGS. 3 and 4, shown is a portable engine-generator combination 100 having multi-fuel capability. The portable engine-generator combination 100 includes a spark ignited internal combustion engine 30 for powering the electrical generator 102, the spark ignited internal combustion engine 30 having an air inlet 104 and an exhaust 106. An engine controller 26 is provided to control engine output.

As described hereinabove, and with reference also to FIGS. 1 and 2, the portable engine-generator combination 100 is provided with an automated system 10 for managing temperature and reducing fuel dilution in an internal combustion engine 30. In some embodiments, the internal combustion engine may be an air-cooled spark ignited internal combustion engine 30.

The system 10 disclosed herein includes a rotatable shutter plate 12 having an open portion 14, a closed portion 16 and a peripheral rim 18. The peripheral rim 18 of the rotatable shutter plate 12 includes a frictional surface 28. As shown in FIG. 1, in some embodiments, the frictional surface 28 of the peripheral rim 18 of the rotatable shutter plate 12 includes a series of gear teeth 32.

The system 10 also includes a motor 20 having a rotatable shaft 22 for rotating the rotatable shutter plate 12. In some embodiments, the rotatable shaft 22 of the motor 20 includes a pinion 34 affixed at one end 36 thereof for engagement with the frictional surface 28 of the peripheral rim 18. In some embodiments, the pinion 34 affixed to the rotatable shaft 22 includes a series of gear teeth 38 for meshing with the series of gear teeth 32 of the frictional surface 28 of the peripheral rim 18.

Referring again to FIG. 3, a temperature sensor 24 for monitoring a temperature indicative of engine warm-up and sending a signal to a controller 26. Advantageously, the rotatable shutter plate 12 is structured and arranged to at least partially restrict air flow inlet to the internal combustion engine 30 when rotated in response to a signal received from the controller 26.

In operation, when fuel dilution can be problematic, the rotatable shutter plate 12 may be rotated to a first position P', so as to at least substantially occlude the air inlet(s) 40 or the air outlet 42 (see FIG. 4) of engine housing 44. When the engine 30 is at, or has approached, operating temperature, the rotatable shutter plate 12 may be rotated to a second position P" (see FIG. 1), so as to minimally occlude the air inlet 40 or the air outlet 42. To further optimize engine operating parameters, one or more additional sensors may be employed. For example, in some embodiments an engine block temperature sensor may be provided. Signals obtained from engine block temperature sensor may be used by the controller to minimize the dilution of crankcase oil by fuel during cold engine operation. In a similar manner, an intake manifold air temperature sensor may be employed to optimize other operating parameters.

To further optimize engine operating parameters, one or more additional sensors may be employed. For example, in some embodiments an engine block temperature sensor may be provided. Signals obtained from engine block temperature sensor may be used by the controller to minimize the dilution of crankcase oil by fuel during cold engine operation. In a similar manner, an intake manifold air temperature sensor may be employed to optimize other operating parameters.

As may be appreciated, conventional spark-ignited engines, which may include by way of example and not of limitation, portable engine-generator combinations, can be converted to multi-fuel operation. Suitable portable engine-generator combinations that may be employed for such conversions include the Honda EU Series Portable Inverter Generator series, which may be obtained from a wide variety of commercial sources, supplied by American Honda Power Equipment Division of Alpharetta, Ga., USA.

The selection of an ideal spark ignited internal combustion engine for conversion to operation on middle-distillate fuels, while minimizing the incidence of engine knock, will depend upon engine operating parameters, such as engine speed and compression ratio, as well as the maintenance of combustion and engine head temperature, which can be influenced by air/fuel ratio, ignition and valve timing, and cooling. As those skilled in the art will recognize, spark timing can also be adjusted, if necessary, to decrease the incidence of knock. In addition, the incidence of oil dilution with fuels less volatile than gasoline, such as diesel fuel or jet fuel, can be reduced by maintaining engine temperature above a certain threshold, which can be controlled by controlling the engine cooling system. The optimal temperature range, to be warm enough to avoid oil dilution, while cool enough to avoid engine knock, both of which would be important for long-life operation, will depend upon the specifics of the selected spark-ignition engine. The aforementioned Honda systems have been found to achieve these requirements. For the systems tested, oil temperatures in the range of 70° C. to 90° C. have been found to be optimal for both criteria.

In another aspect, provided is a method of reducing fuel dilution and managing temperature in a spark-ignited engine operating on middle-distillate fuel. The method includes starting the spark-ignited engine; monitoring a temperature indicative of engine warm-up and sending a signal to a controller; and at least partially restricting air flow to the spark-ignited engine in response to a signal received from the controller.

In some embodiments, the step of at least partially occluding an air inlet to the spark-ignited engine in response to a signal received from the controller employs a system comprising (i) a rotatable shutter plate having an open portion, a closed portion and a peripheral rim; and (ii) a motor having a rotatable shaft for rotating the rotatable shutter plate.

In some embodiments, the peripheral rim comprises a frictional surface. In some embodiments, the frictional surface of the peripheral rim comprises a series of gear teeth.

In some embodiments, the rotatable shaft of the motor comprises a pinion affixed at one end thereof for engagement with the frictional surface of the peripheral rim. In some embodiments, the pinion affixed to the rotatable shaft comprises a series of gear teeth for meshing with the series of gear teeth of the frictional surface of the peripheral rim.

In some embodiments, the rotatable shutter plate at least substantially occludes an air inlet or an air outlet when rotated to a first position and minimally occludes the air inlet or the air outlet when rotated to a second position.

In some embodiments, the step of at least partially occluding an air inlet to the spark-ignited engine in response to a signal received from the controller further employs a base plate for mounting the rotatable shutter plate thereto, the base plate having an open section and a closed section.

In some embodiments, the base plate is positioned over the air inlet or the air outlet to the internal combustion engine. In some embodiments, the base plate is formed from a thermoplastic material.

In some embodiments, the rotatable shutter plate is formed from a metallic material. In some embodiments, the metallic material comprises aluminum.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

Illustrative, non-exclusive examples of systems and methods according to the present disclosure have been described. It is within the scope of the present disclosure that an individual step of a method recited herein, including in the following enumerated paragraphs, may additionally or alternatively be referred to as a "step for" performing the recited action.

INDUSTRIAL APPLICABILITY

The systems and methods disclosed herein are applicable to the automotive, small engine, portable generator industries and to the military.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. An automated system for managing temperature and reducing fuel dilution in an internal combustion engine, the system comprising:

(a) a rotatable shutter plate having an open portion, a closed portion and a peripheral rim;

(b) a motor having a rotatable shaft for rotating the rotatable shutter plate; and (c) a temperature sensor for monitoring a temperature indicative of engine warm-up and sending a signal to a controller;

wherein the rotatable shutter plate is structured and arranged to at least partially restrict cooling air flow past the internal combustion engine when rotated in response to a signal received from the controller.

2. The system of claim 1, wherein the peripheral rim comprises a frictional surface.

3. The system of claim 2, wherein the frictional surface of the peripheral rim comprises a series of gear teeth.

4. The system of claim 3, wherein the rotatable shaft of the motor comprises a pinion affixed at one end thereof for engagement with the frictional surface of the peripheral rim.

5. The system of claim 4, wherein the pinion affixed to the rotatable shaft comprises a series of gear teeth for meshing with the series of gear teeth of the frictional surface of the peripheral rim.

6. The system of claim 1, wherein the rotatable shutter plate at least substantially occludes an air inlet or an air outlet when rotated to a first position and minimally occludes the air inlet or the air outlet when rotated to a second position.

7. The system of claim 1, further comprising a base plate for mounting the rotatable shutter plate thereto, the base plate having an open section and a closed section.

8. The system of claim 7, wherein the base plate is positioned over the air inlet or the air outlet to the internal combustion engine.

9. The system of claim 7, wherein the base plate is formed from a thermoplastic material.

10. The system of claim 1, wherein the rotatable shutter plate is formed from a metallic material.

11. The system of claim 10, wherein the metallic material comprises aluminum.

12. The system of claim 1, wherein the internal combustion engine is an air-cooled internal combustion engine.

13. A method of reducing fuel dilution and managing temperature in a spark-ignited engine operating on middle-distillate fuel comprising:

(a) starting the spark-ignited engine;

(b) monitoring a temperature indicative of engine warm-up and sending a signal to a controller; and (c) at least partially restricting cooling air flow past the spark-ignited engine in response to a signal received from the controller.

14. The method of claim 13, wherein the step of at least partially restricting cooling air flow past the spark-ignited engine in response to a signal received from the controller employs a system comprising:

(i) a rotatable shutter plate having an open portion, a closed portion and a peripheral rim; and (ii) a motor having a rotatable shaft for rotating the rotatable shutter plate.

15. The method of claim 14, wherein the peripheral rim comprises a frictional surface.

16. The method of claim 15, wherein the frictional surface of the peripheral rim comprises a series of gear teeth.

17. The method of claim 16, wherein the rotatable shaft of the motor comprises a pinion affixed at one end thereof for engagement with the frictional surface of the peripheral rim.

18. The method of claim 17, wherein the pinion affixed to the rotatable shaft comprises a series of gear teeth for meshing with the series of gear teeth of the frictional surface of the peripheral rim.

19. The method of claim 14, wherein the rotatable shutter plate at least substantially occludes an air inlet or an air outlet when rotated to a first position and minimally occludes the air inlet or the air outlet when rotated to a second position.

20. The method of claim 14, further comprising a base plate for mounting the rotatable shutter plate thereto, the base plate having an open section and a closed section.

21. The method of claim 20, wherein the base plate is positioned over the air inlet or the air outlet to the internal combustion engine.

22. The method of claim 21, wherein the base plate is formed from a thermoplastic material.

23. The method of claim 14, wherein the rotatable shutter plate is formed from a metallic material.

24. The method of claim 23, wherein the metallic material comprises aluminum.

25. A portable engine having multi-fuel capability, comprising:

(a) an internal combustion engine suitable for powering an electrical generator, the internal combustion engine having a cooling air inlet, and a cooling air outlet; and (b) an automated system for managing temperature and reducing fuel dilution in the internal combustion engine, the system including (i) a rotatable shutter plate having an open portion, a closed portion and a peripheral rim;

(ii) a motor having a rotatable shaft for rotating the rotatable shutter plate; and (iii) a temperature sensor for monitoring a temperature indicative of engine warm-up and sending a signal to a controller;

wherein the rotatable shutter plate is structured and arranged to at least partially restrict cooling air flow past the internal combustion engine when rotated in response to a signal received from the controller.

26. The portable engine of claim 25, wherein the peripheral rim comprises a frictional surface.

27. The portable engine of claim 26, wherein the frictional surface of the peripheral rim comprises a series of gear teeth.

28. The portable engine of claim 27, wherein the rotatable shaft of the motor comprises a pinion affixed at one end thereof for engagement with the frictional surface of the peripheral rim.

29. The portable engine of claim 28, wherein the pinion affixed to the rotatable shaft comprises a series of gear teeth for meshing with the series of gear teeth of the frictional surface of the peripheral rim.

30. The portable engine of claim 25, wherein the rotatable shutter plate at least substantially occludes an air inlet or an air outlet when rotated to a first position and minimally occludes the air inlet or the air outlet when rotated to a second position.

31. The portable engine of claim 25, further comprising a base plate for mounting the rotatable shutter plate thereto, the base plate having an open section and a closed section.

32. The portable engine of claim 31, wherein the base plate is positioned over the air inlet to the internal combustion engine.

33. The portable engine of claim 32, wherein the base plate is formed from a thermoplastic material.

34. The portable engine of claim 25, wherein the rotatable shutter plate is formed from a metallic material.

35. The portable engine of claim 34, wherein the metallic material comprises aluminum.

36. The portable engine of claim 25, wherein the internal combustion engine is an air-cooled internal combustion engine.

37. The portable engine of claim 25, further comprising an electric generator operably attached thereto.

* * * * *